United States Patent [19]

Vendramini

[11] 4,025,414

[45] May 24, 1977

[54] DEVICE FOR CLAMPING A BODY AGAINST DOWNWARD MOVEMENT

[76] Inventor: Alessandra Vendramini, Viale Kennedy, 17, I - 24020 Torre Boldone (Bergamo), Italy

[22] Filed: Sept. 30, 1975

[21] Appl. No.: 618,232

[30] Foreign Application Priority Data

May 23, 1975 Italy ..... 2913/75

[52] U.S. Cl. ..... 204/297 R; 24/244; 24/263 SW; 24/263 A; 403/409; 24/248 D

[51] Int. Cl.² ..... C23B 5/70; A44B 21/00

[58] Field of Search ..... 24/244, 263 SW, 263 C, 24/263 A, 263 B, 248 D, 211 N, 263 FS, 263 DP, 136 B, 115 L; 339/273 R, 266 R; 403/409, 374; 204/297 R, 297; 269/234, 91

[56] References Cited

UNITED STATES PATENTS

| | | | |
|---|---|---|---|
| 620,495 | 2/1899 | Ramseaur | 24/263 B |
| 895,646 | 8/1908 | Ladd | 24/263 B |
| 1,400,491 | 12/1921 | Mechling | 24/263 A |
| 2,534,970 | 12/1950 | Hausman | 339/273 R |
| 2,625,861 | 1/1953 | Swanson | 24/263 A |

*Primary Examiner*—Bernard A. Gelak
*Attorney, Agent, or Firm*—Steinberg and Blake

[57] ABSTRACT

Device for electrode clamping against supporting crosspieces in electrolytic cells for aluminum production, comprising a clamping unit for each of the electrodes, which clamping unit is transversely arranged on the brackets having the electrode inserted therebetween, with a drive element centrally arranged between said two clamping elements to urge one of the clamping elements against the front edges of the brackets and the other against the front surface of the electrode.

7 Claims, 6 Drawing Figures

DEVICE FOR CLAMPING A BODY AGAINST DOWNWARD MOVEMENT

This invention relates to a device for clamping the electrodes against the supporting crosspieces in the electrolytic cells for the production of aluminum, which device comprises for clamping each of the electrodes a clamping unit that is transversely arranged on the two brackets having the electrode inserted therebetween, with a drive element centrally arranged between said two clamping elements for urging one of such clamping elements against the front edges of the brackets and the other against the front surface of the electrode.

As well known, electrolytic tanks for the production of aluminum and like metals have thereon a crosspiece, on which the stems of anodes drawing in the underlying cells are secured or attached. Each of the stems of these anodes are arranged between two brackets connected to the crosspiece, wherein on each of the brackets a transverse rod is provided which is clamped by a control handwheel against the front surface of the electrode stem, thus blocking the latter against the crosspiece lying behind. Normally, the clamping operation is manually carried out, with the disadvantage that not always the electrode is correctly clamped in place and, due to its own weight, would tend to move downwards, thus providing functional drawbacks. Additionally, an operator assigned to handling the clamping handwheel operates at rather high temperatures and accordingly in an unpleasant work ambient not allowing the required concentration and accuracy in work. In order to avoid the last mentioned disadvantage, a remote clamping device has already been provided, for each of the anodes the device substantially comprising tongs-like or scissors-like elements, of which one end is operated by a drive spindle causing on one hand those ends to move to or away with a corresponding movement to or away of the opposite ends of the scissors bearing against the face of the anode stem and accordingly tending to block it against the crosspiece. To this end, it should be noted that the prior art device exhibits a high friction between the ends of the scissors elements touching the anode stem and the stem surface, so that rather powerful and rugged motors are required to overcome such a friction. The main disadvantage in the prior art device consists however in that the pivot is located centrally of the lever arms forming the scissors and is under current relative to only one face of the scissors, whereby sparkings are generated which would cause "burnings off" on the pivot surface, and accordingly wear and misalignment of the pivots with resulting poor efficiency of the clamping units. Finally, the severe slipping of the scissors element ends against the front surface of the anode shank may sometimes put the electrodes out of use.

It is the object of the present invention to provide a device for clamping the electrodes against the supporting crosspieces in the electrolytic cells for the production of aluminum, which is remote controllable, is reliable in operation and use and of a simple construction, while ensuring a selfblocking effect against the anode tendency of downward slipping.

According to the invention, this is accomplished by a device for the above disclosed objects, characterized in that for each of the electrodes to be clamped on the crosspiece, the device comprises a clamping unit arranged for transversely acting upon the two brackets lining the electrode, with a pressure element intended to engage the front surface of the electrode shank, and an opposite pressure element engaging the front ridges or projections of the brackets, as well as a control or drive member centrally arranged between said two pressure elements.

An embodiment of the device according to the present invention contemplates that said two pressure elements are formed from tube-like cylindrical elements, as arranged within a box to transversely act upon the brackets, said box being open at at least one front end for the engagement of said cylindrical elements with the front surface of the electrode and the front edge of the brackets, respectively, and that said centrally arranged control or drive member comprises a wedge element, the major base of which is downward facing, provided with a threaded hole mounted on a corresponding threaded section of a rotable spindle which is remote driven by a reversing motor.

Another embodiment of the invention contemplates that said pressure elements comprise arms which are centrally articulated and longitudinally arranged of said supporting brackets with transverse pins at the front edges of the brackets and the front face of the anode stem, and that said control or drive element comprises a spindle that can rotate in either direction with transverse connecting elements to the central articulations or links of said arms for raising or lowering the latter, said transverse pins being a slight sliding fit in the seats provided at the ends of said arms, the pin facing the anode being shaped as a disc-like cam.

An advantage of the device according to the invention resides in that, owing to the provision of the upward facing wedge in the first embodiment, and owing to the pin provided with a disc-like cam in the second embodiment, any downward slipping of the anode would tend to increasingly engage these clamping elements, thus providing a self-blocking effect.

These and further objects, features, peculiarities and advantages of the device according to the invention will become more apparent to those skilled in the art from the following detailed description of two embodiments, given by mere way of unrestrictive example, when read in connection with the accompanying drawings, in which.

Figure 1:
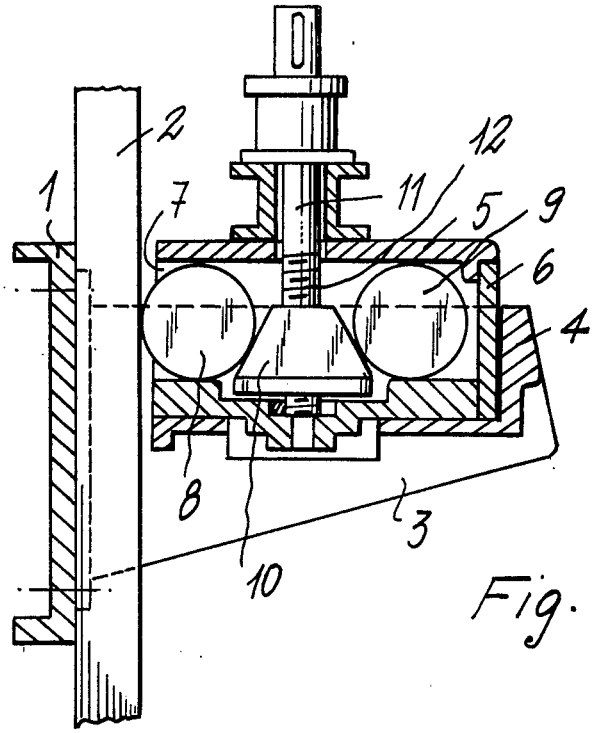
FIG. 1 is a side sectional view of the device according to the invention.
Figure 2:
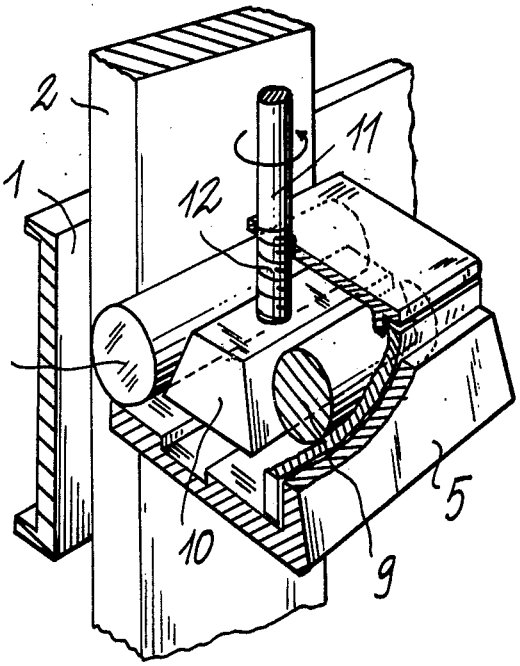
FIG. 2 is a perspective view with parts partially cut away.
Figure 3:
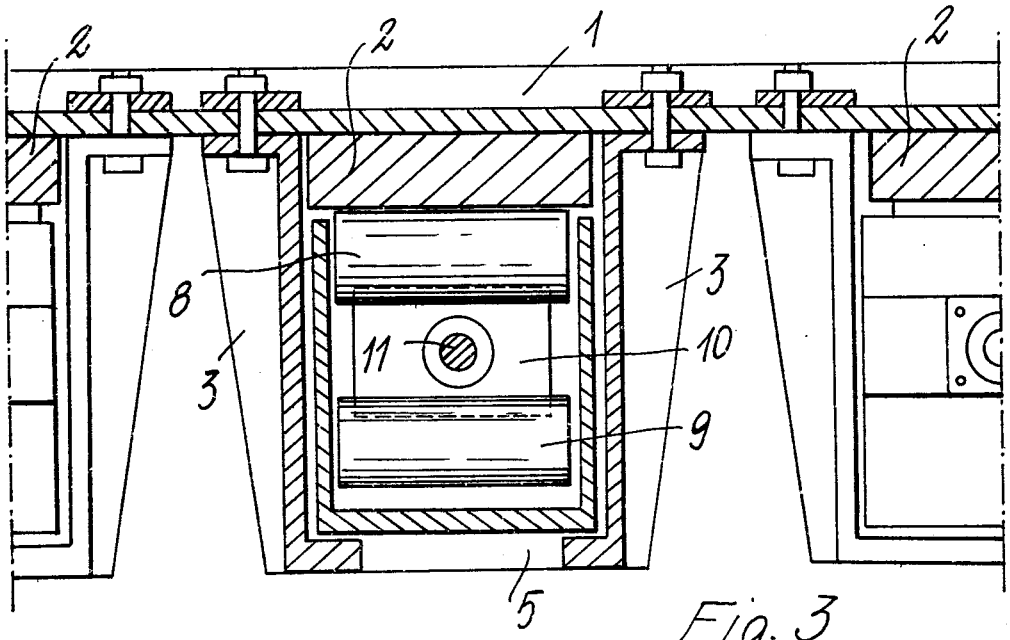
FIG. 3 is a plan view showing a plurality of side-by-side devices in the embodiment according to the preceding figures.

Referring now to FIGS. 1, 2 and 3, reference numeral 1 designates the electrode carrying crosspiece, having secured or attached thereon the several stems 2 of the electrodes, drawing with the lower end thereof in the underlying electrolytic cell. On the crosspiece, at the sides of each of the stems to be secured or attached, there are provided a pair of brackets 3, 3, having at the front a beak-like ridge or projection.

In the embodiment shown in FIGS. 1, 2 and 3, the clamping device according to the invention comprises a box-like body 5 which is slotted at 7 and at its rear where a plate 6 and is loosely mounted. Within said box-like body, transversely bearing on brackets 3, there are arranged a pair of tube-like cylindrical elements 8 and 9, which are likewise transversely arranged and, if required, can protrude from slot 7 and press against plate 6, these elements being freely movable arranged.

A wedge 10 is provided between said two cylinders 8 and 9 and has its major base downward facing, the wedge being mounted with its threaded inner hole receiving a rotable spindle 11, the latter being threaded at 12 and operable by a reversing motor. Thus, as apparent, when anode 2 has been positioned, should spindle 11 be operated in suitable direction of rotation by its drive motor, wedge 10 would be upward moved on said threaded section 12. On upward moving, said element 10 is wedged between cylinders 8 and 9, so that cylinder 9 presses plate 6 against the inner face of beak 4, while cylinder 8 through slot 7 presses on the front face of the electrode stem 2. Thus, due to linear displacement of cylinders 8 and 9, a firm clamping action occurs, but without any slippings being exerted on the electrode face. On the other hand, should for any trouble electrode 2 tend to move downwards, cylinder 8 would be resisted by wedge 10 which, upon possible tendency of electrode 2 to move downwards, tends to draw cylinder 8 on wedge 10 (and hence on an inclined plane or chute), exerting an increased pressure on cylinder 8 against said electrode, thus providing a self-blocking effect.

Figure 4:
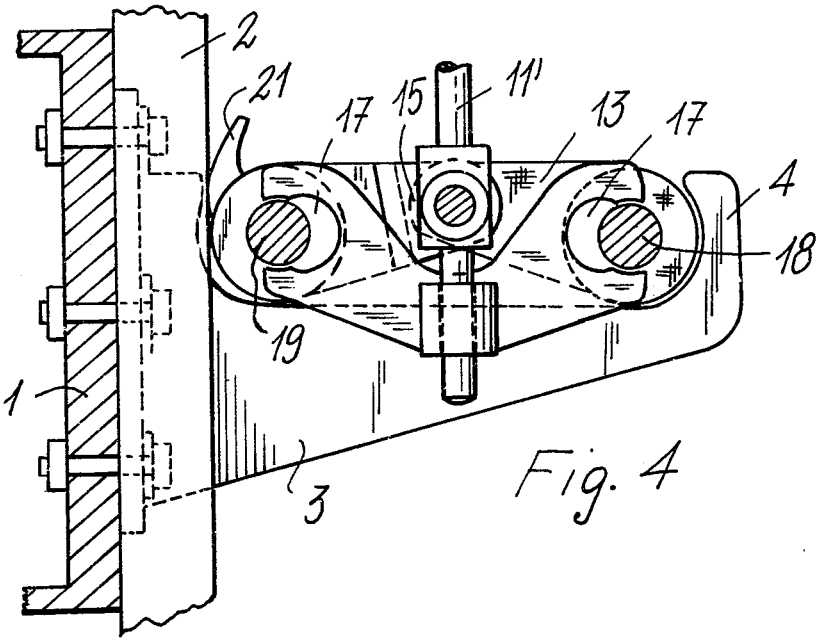
FIG. 4 is a side view at closed position of a further embodiment.
Figure 5:
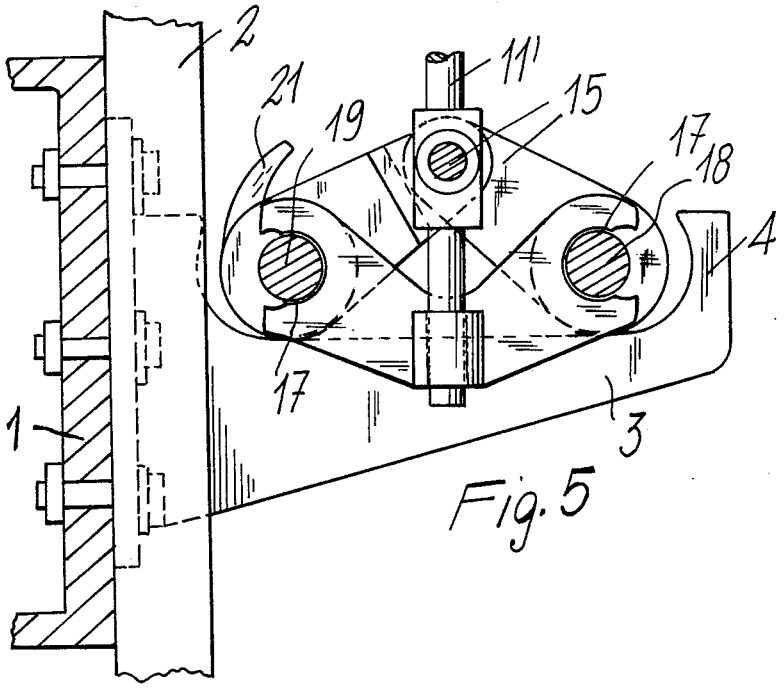
FIG. 5 is a view at open position of the same device shown in FIG. 4.
Figure 6:
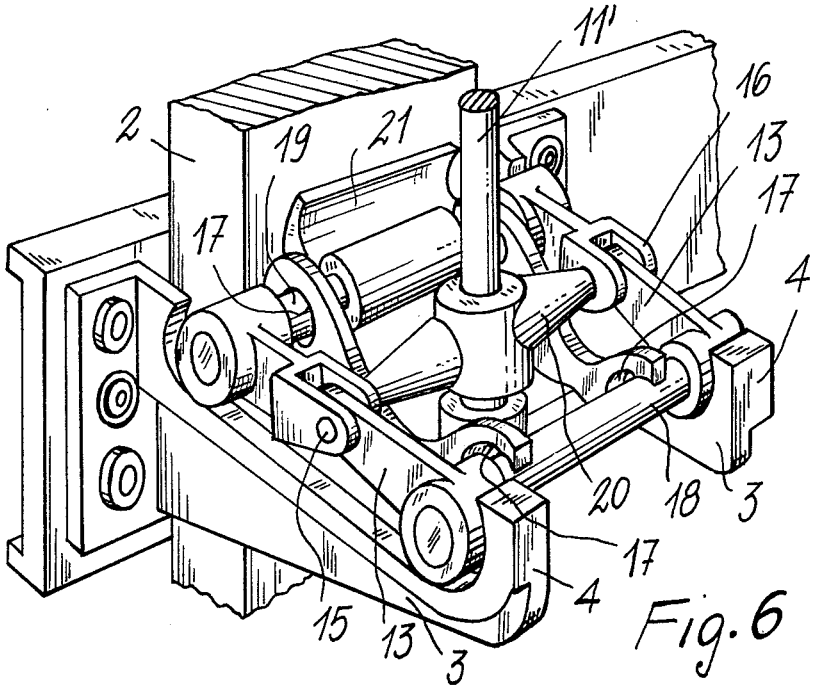
FIG. 6 is a perspective view showing such a device.

Referring now to FIGS. 4, 5 and 6, a modified embodiment will now be described, in which like or equivalent parts carry the same reference numerals. As it will be seen, also in this case crosspiece 1 has for each of anodes 2 a pair of brackets 3 provided with beaks 4. In this case, beaks 4 have a rounded inner surface. The actual clamping device comprises two pairs of articulated arms 13, 13 longitudinally extending of said brackets 3. The pairs of arms 13, 13 are centrally articulated by pivot 15 and 16, respectively, and at the front and rear have fork seats, generally designated at 17 for receiving transverse pins 18 and 19 at the inner face of beaks 4 and front surface of the electrode stem 2, respectively.

Also in this case, a central drive spindle 11′ is provided and connected to a reversing motor, here not shown, which can be rotated in either direction. The rotation of spindle 11′, upon screwing or unscrewing of a scroll element 20, connected to pivots 15 and 16, causes the pairs of arms 13 to be raised or lowered, that is the passage from the position shown in FIG. 4 to that shown in FIG. 5, and vice versa. When, according to FIG. 4, arms 13 are lowered or pushed, and accordingly electrode 2 is clamped, pin 18 on one hand engages against the inner front surface of beak 4, while the other pin 19 is contacted and clamped against the surface of electrode 2. Particularly, it will be appreciated that pin 19 has a disc-like cam ridge or projection 21. In case of possible downward slipping of electrode 2, this element 21, as drawn by the electrode, tends to provide a larger engaging surface against the electrode surface, thus providing also in this case a self-blocking effect.

Thus it will be seen that the crosspiece 1 forms a means providing an upright surface against which the structure 2 is to be clamped so as to be held against downward movement. Components 3 form a bracket means having at their projections 4 blocking surfaces which face the upright surface of the means 1 against which the structure 2 is to be clamped. Between this blocking surface of the bracket means 3 and the upright surface of the means 1 is the expandable clamping means of the invention, this expandable clamping means being adapted to be expanded into a clamping position pressing on the one hand against the blocking surface of the bracket means 3 and on the other hand against the structure 2 which is situated against the upright surface of the means 1. The rotary spindles 11, 11′ form an expanding means for operating on the clamping means to expand the latter into its clamping position. In the embodiment of FIGS. 1–3, the expanding means 11 operates to raise the wedge 10 for placing the clamping means in its clamping position, while in the embodiment of FIGS. 4–6 the rotary spindle 11′ operates to lower the pivots 15, 16 so as to spread the outer ends of the arms 13 apart from each other and thus displace the pins 18 and 19 apart from each other. In both embodiments, the clamping means includes an element (element 8 of FIGS. 1–3 and element 21 of FIGS. 4–6) which has a frictional rolling contact with the structure 2 and which automatically responds to the tendency of the structure 2 to move downwardly for tending to increase the dimension of the clamping means between the blocking surface of the bracket means 3 and the upright surface of the means 1 so as to increase the clamping force automatically should the structure 2 tend to move downwardly. In both embodiments it will be noted that this element which has the frictional rolling contact with the structure 2 has in engagement with the structure 2 a convex surface which extends around a horizontal axis.

Although the invention has been herein described in connection with a specific embodiment thereof, the invention is not restricted to the details shown and/or disclosed, but includes all of the changes and equivalent approaches apparent to those skilled in the art. For instance, instead of directly acting upon the surface of the electrode stem, the clamping device according to the invention could act upon an intermediate transverse element, which can be connected and disconnected as required, which would be advantageous when the operations for raising and repositioning the anodes are carried out by trolleys provided with crane arms or jibs, rather than by lifting units comprising bridge cranes.

Therefore, any additions and/or modifications made from those skilled in the art on the ground of the present inventive concept are within the scope of the invention.

What I claim is:

1. An assembly for holding a structure against downward movement, comprising means providing an upright surface against which the structure is adapted to be pressed, bracket means fixedly carried by said means which provides said upright surface, said bracket means having spaced from said upright surface a blocking surface which faces said upright surface, expandable clamping means supported by said bracket means and expanding means cooperating with said expandable clamping means for expanding the latter into a clamping position pressing against said blocking surface of said bracket means and against a surface of a structure situated against said upright surface, said expandable clamping means including an element adapted to press against said structure while having frictional rolling contact therewith, said element having, for engagement with said structure, a convex surface which is curved around a horizontal axis, and said clamping means automatically responding to the tendency of said element to be rolled by said structure, when the latter tends to move downwardly, for increasing the dimension of said clamping means between said blocking surface and said upright surface, whereby the clamping force will automatically tend to increase with any tendency of the structure to move downwardly with respect to said upright surface.

2. The combination of claim 1 and wherein said clamping means includes a wedge having an inclined surface inclined downwardly toward said upright surface, said element of said clamping means being a cylindrical element engaging said inclined surface of said wedge and situated between the latter and said upright surface, and said expanding means including a rotary spindle threaded to said wedge for controlling the elevation thereof.

3. The combination of claim 2 and wherein said clamping means includes a second cylindrical element engaging said wedge at the side thereof distant from said upright surface.

4. The combination of claim 3 and wherein said wedge has oppositely inclined surfaces respectively engaging said cylindrical elements and is of trapezoidal cross section with the base of its trapezoidal cross section facing downwardly.

5. The combination of claim 1 and wherein said expandable clamping means includes a pair of coaxial pivots and a pair of arms connected together by each of said pivots, said expanding means being operatively connected with said coaxial pivots for controlling the elevation thereof, one of the arms of each pair extending from the common axis of said pivots toward said upright surface and the other of the arms of each pair extending from the common axis of said pivots toward said blocking surface, said other arms terminating in free ends carrying an elongated member engaging said blocking surface and said one arms terminating in free ends carrying said element which has said frictional rolling contact with the structure pressed against said upright surface.

6. The combination of claim 5 and wherein said element includes a curved cam providing said convex surface which is curved around said horizontal axis and a pin fixedly carrying said cam and carried by said one arms.

7. The combination of claim 1 and wherein said means providing said upright surface is a crosspiece of an electrolytic cell while the structure to be clamped against said upright surface includes an electrode of said cell.

* * * * *